US010395588B2

(12) United States Patent
Ahmed et al.

(10) Patent No.: US 10,395,588 B2
(45) Date of Patent: Aug. 27, 2019

(54) MICRO LED DISPLAY PIXEL ARCHITECTURE

(71) Applicant: Intel Corporation, Santa Clara, CA (US)

(72) Inventors: Khaled Ahmed, Anaheim, CA (US); Prakash K. Radhakrishnan, Portland, OR (US); Kunjal Parikh, San Jose, CA (US)

(73) Assignee: INTEL CORPORATION, Santa Clara, CA (US)

( * ) Notice: Subject to any disclaimer, the term of this patent is extended or adjusted under 35 U.S.C. 154(b) by 0 days.

(21) Appl. No.: 15/086,611

(22) Filed: Mar. 31, 2016

(65) Prior Publication Data

US 2017/0287399 A1 Oct. 5, 2017

(51) Int. Cl.
*G09G 3/3233* (2016.01)

(52) U.S. Cl.
CPC ... *G09G 3/3233* (2013.01); *G09G 2310/0251* (2013.01); *G09G 2310/0262* (2013.01)

(58) Field of Classification Search
None
See application file for complete search history.

(56) References Cited

U.S. PATENT DOCUMENTS

| | | | |
|---|---|---|---|
| 2001/0007447 | A1 | 7/2001 | Tanaka |
| 2006/0181486 | A1 | 8/2006 | Tseng |
| 2011/0114941 | A1 | 5/2011 | Kato |
| 2014/0167039 | A1 | 6/2014 | Yamazaki |
| 2015/0155334 | A1 | 6/2015 | Lu et al. |

OTHER PUBLICATIONS

PCT Application No. PCT/US2017/013056, International Search Report and the Written Opinion, dated May 30, 2017, 14 pgs.
International Preliminary Report on Patentability received for PCT Patent Application No. PCT/US2017/013056, dated Oct. 11, 2018, 11 pages.

*Primary Examiner* — Gustavo Polo
(74) *Attorney, Agent, or Firm* — Womble Bond Dickinson (US) LLP

(57) ABSTRACT

A Light Emitting Diode (LED) display is described. The LED display includes a plurality of pixel circuits, each including an LED and a non-volatile memory cell to adjust current to the LED.

23 Claims, 6 Drawing Sheets

MICRO LED DISPLAY PIXEL ARCHITECTURE

FIELD

Embodiments described herein generally relate to computer systems. More particularly, embodiments relate to computer system display devices.

BACKGROUND

Active Matrix Organic Light Emitting Diode (AMOLED) displays have been developed for use in a variety of computing displays and devices, including notebook computers, desktop computers, tablet computing devices, mobile phones (e.g., smart phones) automobile in-cabin displays, on appliances, as televisions, etc. An AMOLED display generally includes an array of pixels, with each pixel defining an active pixel area and an associated pixel circuit for driving an active pixel area.

A conventional display pixel used in AMOLEDs generally has two thin film transistors ("TFTs"), a storage capacitor, and an organic light emitting diode ("OLED"). The two TFTs include a switching TFT and a driver TFT. During operation, the switching TFT is turned on, resulting in the data signal being propagated to a storage node. This action charges the storage capacitor and sets up the gate voltage of the driver TFT. The driver TFT then converts the data signal into the electrical current. Thus, the output current of the driver TFT determines the resulting brightness of the OLED. The conventional pixel uses a storage capacitor to hold the electrical charges in the pixel. However, the charges stored in the capacitor constantly leak out, and therefore, refresh cycles are required to maintain a static image. Such refresh cycles increase the power consumption of the display system.

Further, since an OLED is a current-driven device whose luminance is determined by the passing current, uniformity between current provided to different pixels of an OLED panel is crucial for providing quality images to a panel implementing current-mode AMOLEDs.

BRIEF DESCRIPTION OF THE DRAWINGS

Embodiments are illustrated by way of example, and not by way of limitation, in the figures of the accompanying drawings in which like reference numerals refer to similar elements.

DETAILED DESCRIPTION

A pixel architecture for a micro LED display is described below. In the description, numerous specific details, such as component and system configurations, may be set forth in order to provide a more thorough understanding of the present invention. In other instances, well-known structures, circuits, and the like have not been shown in detail, to avoid unnecessarily obscuring the present invention.

Figure 1:
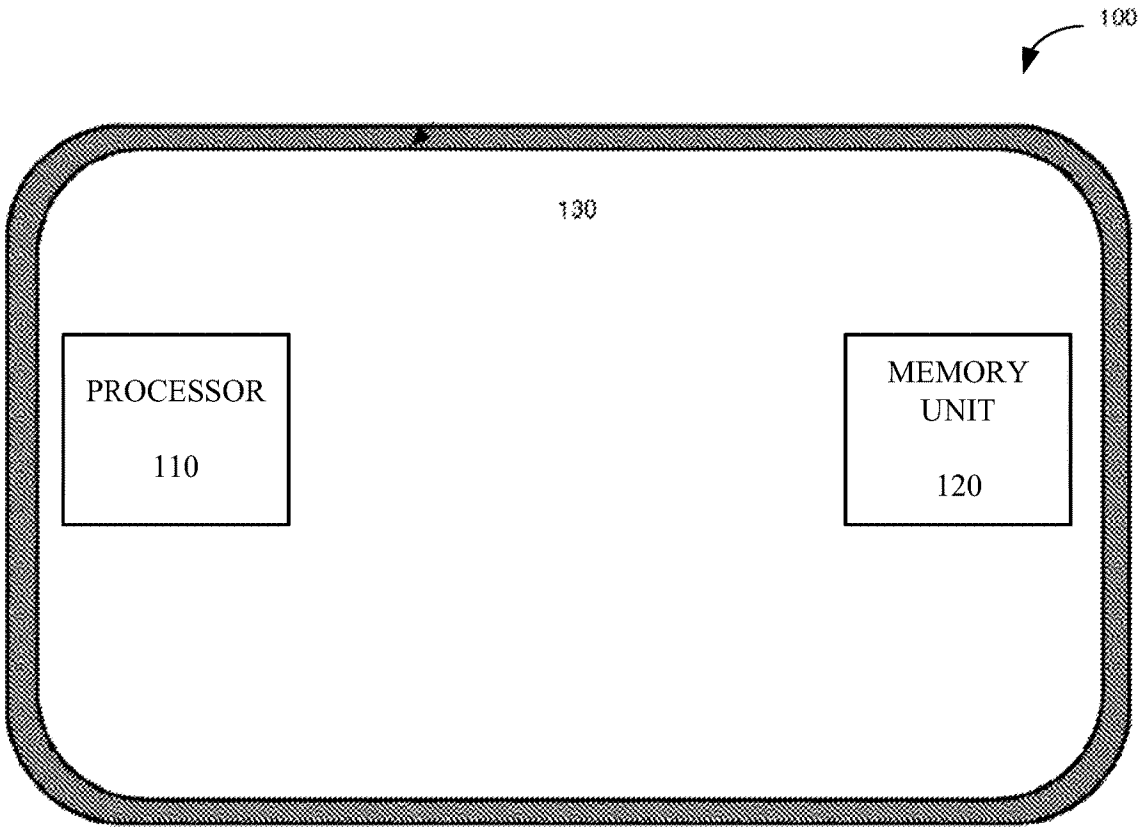
FIG. 1 illustrates one embodiment of a computing system.

FIG. 1 illustrates a block diagram of one embodiment of a mobile device 100. Mobile device 100 may include, but is not limited to, a laptop, a notebook, a handheld computer, a handheld enclosure, a portable electronic device, a mobile internet device (MID), a table, a slate and/or a personal digital assistant. The embodiments, however, are not limited to this example. As shown in the illustrated embodiment of FIG. 1, mobile device 100 may include a processor 110, a memory unit 120 and a screen 130.

Processor 110 may be implemented as any processor, such as a complex instruction set computer (CISC) microprocessor, a reduced instruction set computing (RISC) microprocessor, a very long instruction word (VLIW) microprocessor, a processor implementing a combination of instruction sets, or other processor device. In one embodiment, processor 110 may be implemented as a general purpose processor, such as a processor made by Intel® Corporation, Santa Clara, Calif. Processor 110 may be implemented as a dedicated processor, such as a controller, microcontroller, embedded processor, a digital signal processor (DSP), a network processor, a media processor, an input/output (I/O) processor, and so forth. The embodiments are not limited in this context.

Memory unit 120 may include any machine-readable or computer-readable media capable of storing data, including both volatile and non-volatile memory. For example, memory 120 may include read-only memory (ROM), random-access memory (RAM), dynamic RAM (DRAM), Double-Data-Rate DRAM (DDRAM), synchronous DRAM (SDRAM), static RAM (SRAM), programmable ROM (PROM), erasable programmable ROM (EPROM), electrically erasable programmable ROM (EEPROM), flash memory, polymer memory such as ferroelectric polymer memory, ovonic memory, phase change or ferroelectric memory, silicon-oxide-nitride-oxide-silicon (SONOS) memory, magnetic or optical cards, or any other type of media suitable for storing information. It is worthy to note that some portion or all of the memory 120 may be included on the same integrated circuit as the processor 110, or alternatively some portion or all of the memory 120 may be disposed on an integrated circuit or other medium, for example a hard disk drive, that is external to the integrated circuit of the processor 110. In an embodiment, memory 120 may include data and instructions to operate the processor. The embodiments are not limited in this context.

In one embodiment, screen 130 may provide high brightness and/or contrast. For example, the screen may have a 2000:1 contrast. In an embodiment, screen 130 may have a wide aspect ratio, and may be located on the side of the mobile device. In a further embodiment, screen 130 may be located on a front side or the main side of mobile device. In yet another embodiment, screen 130 may extend to the edge of the mobile device 100. For example, mobile device 100 may have no visible physical bezel connecting or joining the screen 130 to the edge of the mobile device 100.

According to embodiment, screen 130 may include a user interface display and/or a touch screen. The user interface display and/or touch screen may include a graphical user interface. In an embodiment, the entire screen 130 may include a user interface display and/or a touch screen. In an embodiment, only a part of the screen 130 may include a user interface display and/or a touch screen. In a further embodiment, the screen 130 with a user interface display may include one or more interactive and/or non-interactive areas.

In one embodiment, screen 130 comprises an organic light emitting diode (OLED) display, such an AMOLED display.

Figure 2:
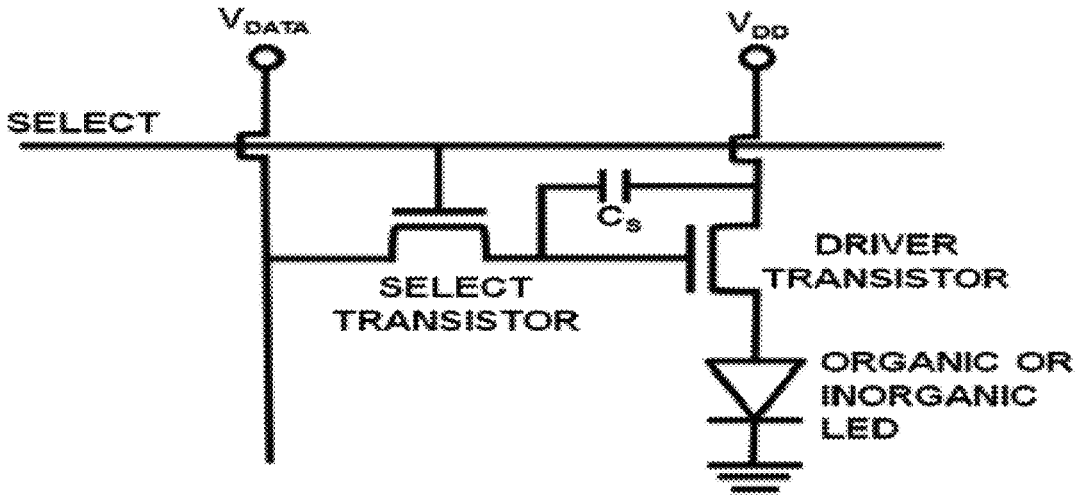
FIG. 2 (PRIOR ART)
FIG. 2 illustrates a conventional AMOLED pixel circuit schematic.

However in other embodiments an inorganic LED may be implemented. FIG. 2 illustrates a schematic of a conventional AMOLED pixel circuit used in AMOLEDs. As discussed above, the switching TFT is turned on during operation, resulting in the data signal being propagated to a storage node. This action charges the storage capacitor and sets up the gate voltage of the driver TFT, which converts the data signal into the electrical current. Thus, the output current of the driver TFT determines the resulting brightness of the OLED. However, the charges stored in the capacitor constantly leak out, thus requiring refresh cycles to maintain a static image.

Figure 3:
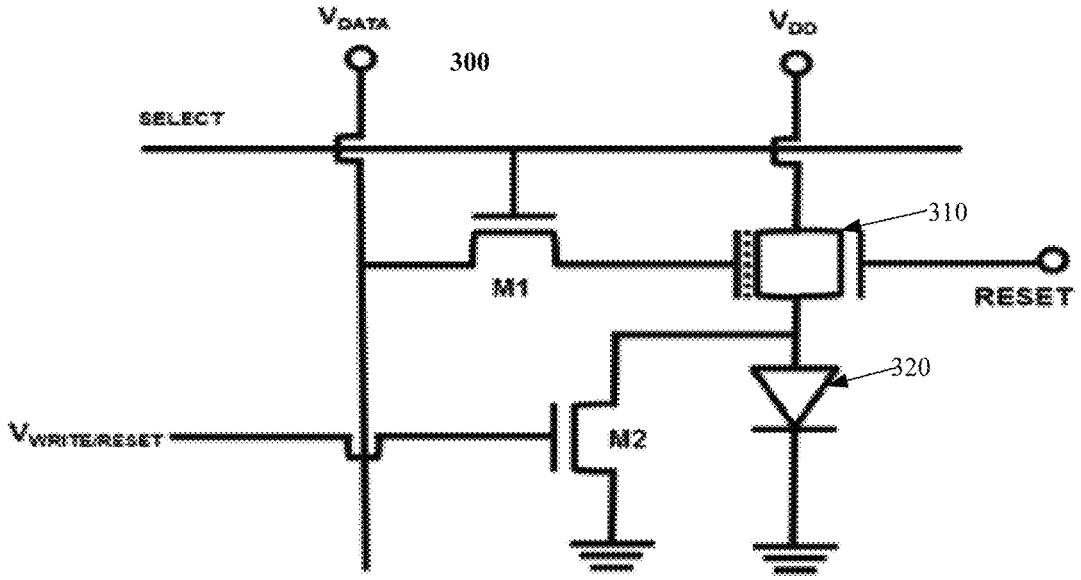
FIG. 3 illustrates a schematic of one embodiment of a AMOLED pixel circuit.

According to one embodiment, screen 130 comprises an AMOLED display implementing display pixels that eliminate refresh cycles and provide high luminance uniformity. However in other embodiments screen 130 may implement an inorganic LED. FIG. 3 illustrates one embodiment of a schematic of a AMOLED pixel 300. As shown in FIG. 3, pixel 300 includes a select TFT (M1), a write/reset TFT (M2), a non-volatile memory (NVM) cell 310 and an LED 320.

Figure 4A:
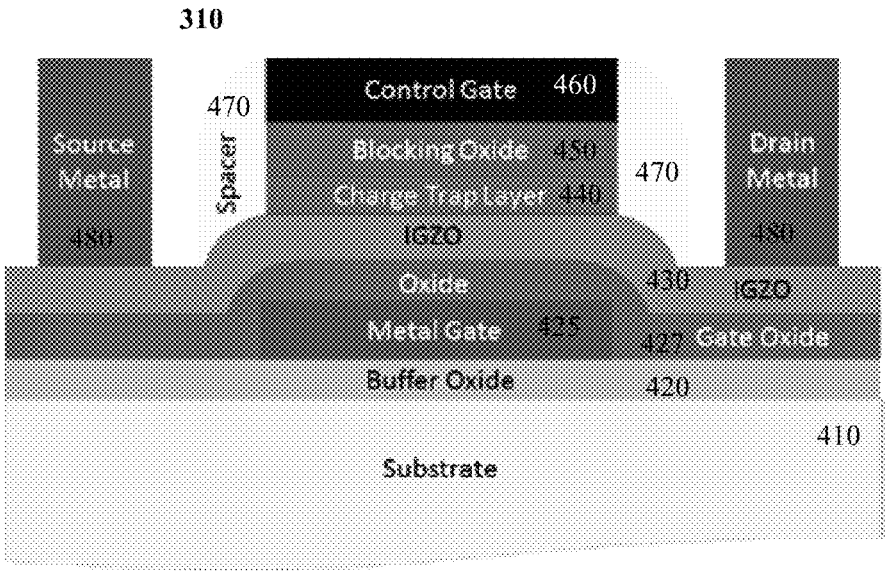
FIGS. 4A & 4B illustrate a schematic of one embodiment of an energy band diagram of a memory cell.
Figure 4B:
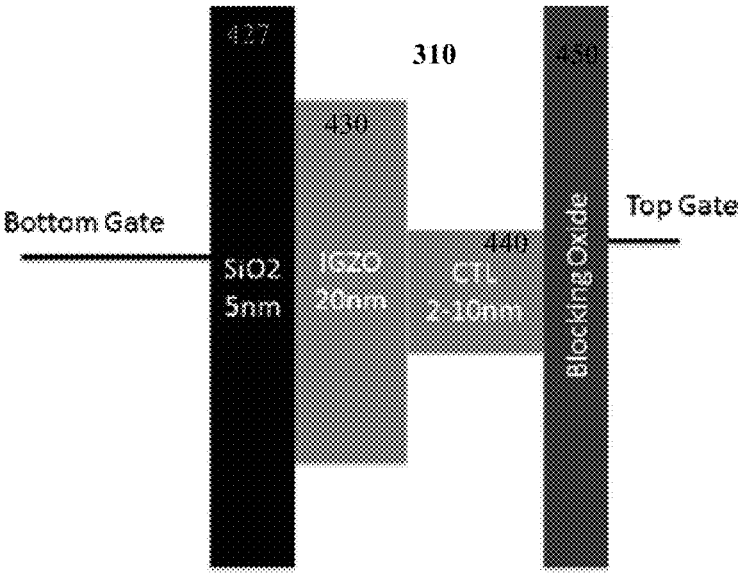

In one embodiment, LED 320 current is adjusted by applying data voltages ($V_{DATA}$) to program (e.g., change the threshold voltage of) NVM cell 310. Thus, the threshold voltage of NVM cell 310 is controlled by $V_{DATA}$. FIGS. 4A & 4B illustrate a schematic of one embodiment of an energy band diagram of a NVM cell 310. In one embodiment, NVM cell 310 includes a double gate structure that produces efficient program/erase operations. FIG. 4A illustrates the layers of NVM cell 310, which includes a top control gate 460, a charge trapping layer 440 (e.g., $Si_3N_4$, metallic or semiconducting nanoparticles), and a blocking oxide layer 450 positioned between. In alternative embodiments, charge trapping layer 440 may comprise other layers (e.g., Hafnium Oxide ($HfO_2$)).

Additionally, NVM cell 310 includes a thin film Indium gallium zinc oxide (IGZO) (or Sn—Ga—Zn—O, Ga—Zn—O—N) channel layer 430, a gate insulator (e.g. silicon dioxide ($SiO_2$) or silicon nitride ($Si_3N_4$)) 427, and a bottom metal gate 425 positioned over a buffer oxide 420 and substrate 410. In one embodiment, source and drain contacts 480 are formed without forming junctions, such as in making IGZO thin film transistor (TFT) for display applications. The use of metallic or semiconducting nanoparticles (NPs) as the charge-trapping layer in NVM cell 310 is advantageous since they make the charge-trapping layer discontinuous and isolated. Accordingly, problems arising from the use of continuous floating gates in conventional non-volatile memory devices are effectively prevented or reduced. FIG. 4B illustrates another view of NVM cell 310.

In one embodiment, NVM cell 310 may perform WRITE, ERASE and READ operations. During a WRITE operation, bottom gate 425 is biased so that accumulation electrons will form a channel between source and drain. As a result, electrons are trapped by charge trapping layer 440. The negative charge due to trapped electrons shifts the threshold voltage of the bottom-gate controlled transistor by an amount that depends on the charge density, gate oxide thickness, and channel thickness. The bias on the top control gate 460 can be used to accelerate programming.

During an ERASE operation, bottom gate 425 is biased so that the IGZO channel layer 430 is depleted, and electrons in the charge trapping layer is de-trapped. The bias on top control gate 460 accelerates the de-trapping of electrons from charge trapping layer 440. A negative bias/pulse is applied to control gate 460. During a READ operation, the drain current is sensed at low voltage (e.g., Vg=1) when top control gate 460 is floating.

Referring back to FIG. 3, the threshold voltage of NVM cell 310 determines the current that drives the LED 320. In one embodiment, the brightness of the pixel may be controlled with different programming signals. In such an embodiment, LED 320 current is adjusted by applying DATA voltages to program (e.g., change the threshold voltage of) NVM cell 310. The threshold voltage of NVM cell 310 is therefore controlled by $V_{DATA}$.

To provide a Reset pulse, the current and voltage of NVM cell 310 shifts positively proportional to an injected charge into the IGZO channel layer 430. In one embodiment, transistor M2 is activated (e.g., ON) and V WRITE/RESET=VDD. As a result, current through LED 320=zero; SELECT=0; M1 is de-activated (e.g., OFF); and RESET=VDD.

During a Write operation to NVM cell 310 transistor M2 is again ON, with $V_{WRITE/RESET}$=VDD. Thus, current through LED 320=zero and SELECT=VDD. Further, control gate 460 of NVM cell 310=−VDATA, which results in electrons entering the channel of NVM and being de-trapped from charge trapping layer 440. A current-voltage (I-V) curve of NVM cell 310 shifts negatively proportional to the value −VDATA. During an Emission operation, $V_{WRITE/RESET}$=0; M2 is OFF; SELECT=0; and RESET=1 (or any appropriate low voltage). This results in the NVM cell 310 transistor being turned on and current flowing through LED 320.□

Figure 5A:
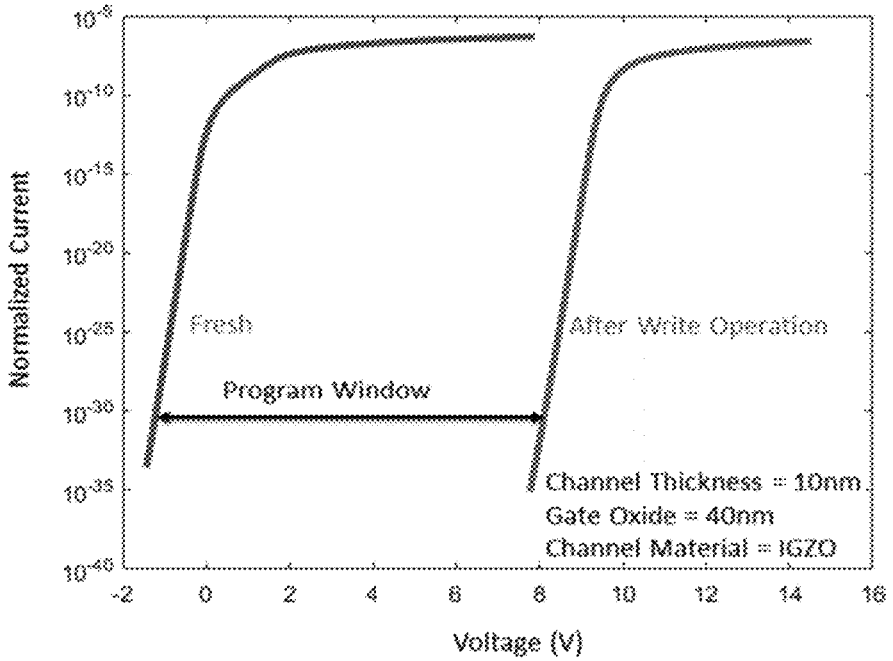
FIGS. 5A 5E illustrate performance simulations for a memory cell.
Figure 5B:
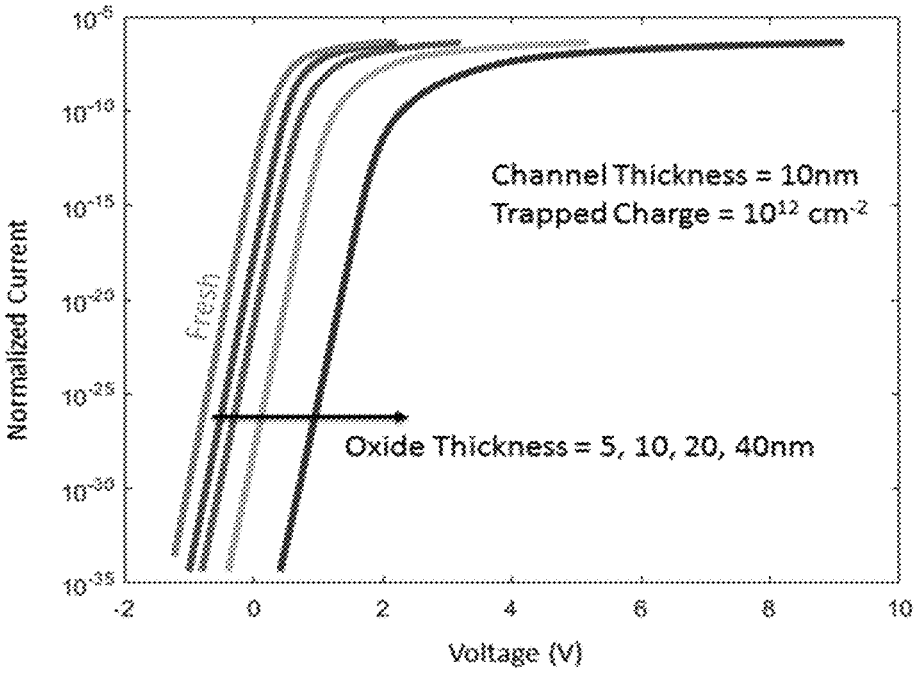
Figure 5C:
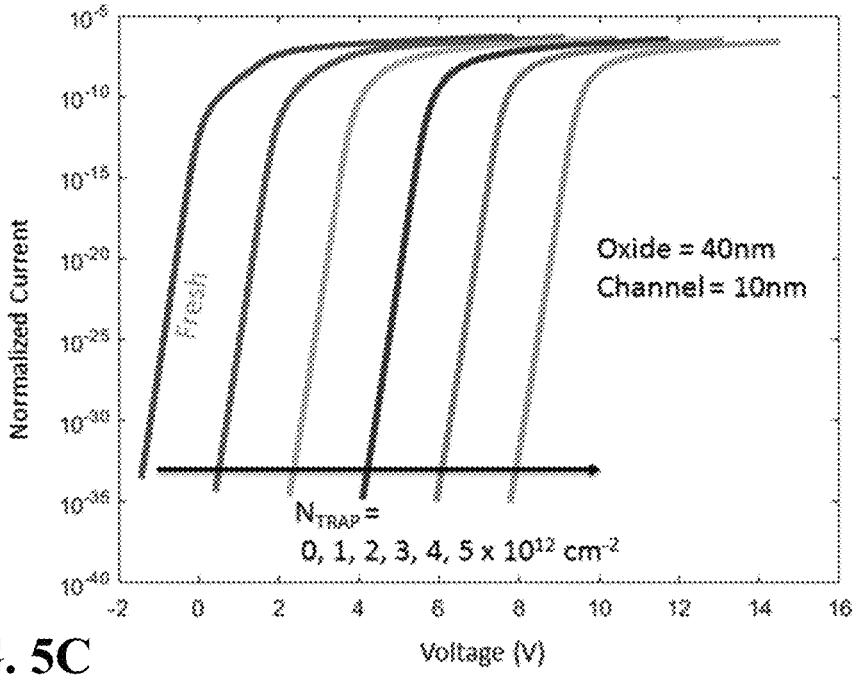

FIGS. 5A-5E illustrate performance simulations for NVM cell 310. FIG. 5A illustrates a simulation of I-V curves for "fresh" and "after programming" FIG. 5B illustrates a dependence of a "program window" on the gate oxide thickness. Thicker gate oxide thickness results in larger threshold voltage shift for the same amount of trapped charges. FIG. 5C illustrates a dependence of a threshold voltage shift as a function of trap density in charge trapping layer 440.

Figure 5D:
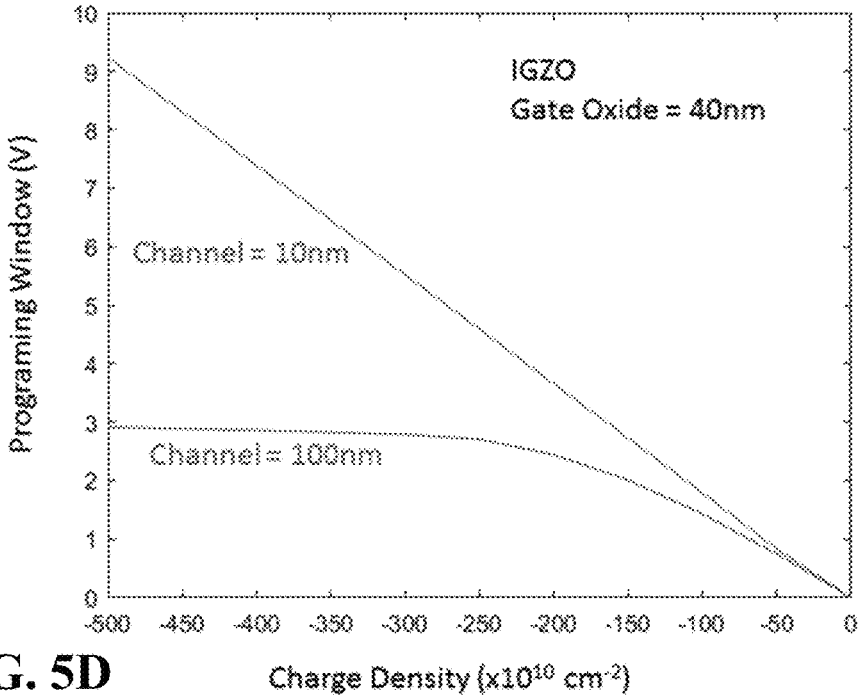
Figure 5E:
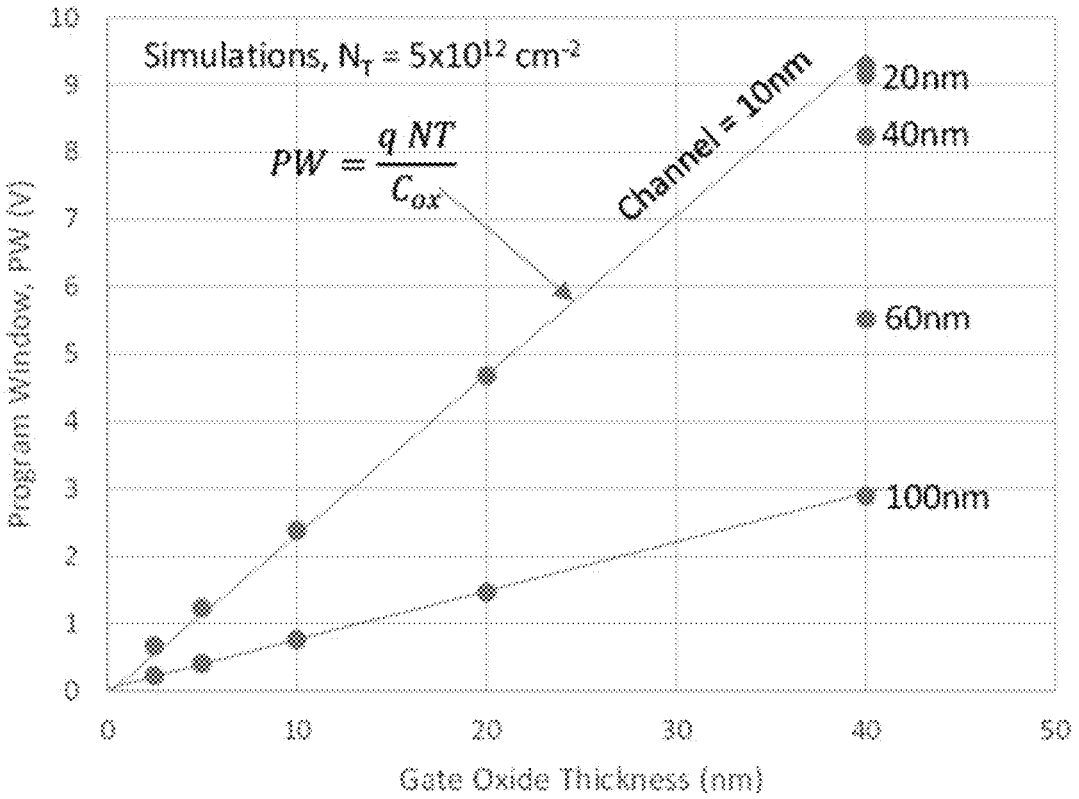

FIG. 5D illustrates a dependence of the program window (threshold voltage shift) on the trapped charges for two different channel layer thicknesses: 10 nm and 100 nm. Thinner channels provide improved linear dependence, which is important for analog operation of the NVM cell 310 in a display pixel. FIG. 5E illustrates a dependence of the threshold voltage shift (or program window) on the gate oxide thickness and channel thickness.

References to "one embodiment", "an embodiment", "example embodiment", "various embodiments", etc., indicate that the embodiment(s) so described may include particular features, structures, or characteristics, but not every embodiment necessarily includes the particular features, structures, or characteristics. Further, some embodiments may have some, all, or none of the features described for other embodiments.

In the following description and claims, the term "coupled" along with its derivatives, may be used. "Coupled" is used to indicate that two or more elements co-operate or interact with each other, but they may or may not have intervening physical or electrical components between them.

As used in the claims, unless otherwise specified the use of the ordinal adjectives "first", "second", "third", etc., to describe a common element, merely indicate that different instances of like elements are being referred to, and are not intended to imply that the elements so described must be in a given sequence, either temporally, spatially, in ranking, or in any other manner.

The following clauses and/or examples pertain to further embodiments or examples. Specifics in the examples may be used anywhere in one or more embodiments. The various features of the different embodiments or examples may be variously combined with some features included and others excluded to suit a variety of different applications. Examples may include subject matter such as a method, means for performing acts of the method, at least one machine-readable medium including instructions that, when performed by a machine cause the machine to performs acts of the method, or of an apparatus or system for facilitating hybrid communication according to embodiments and examples described herein.

Some embodiments pertain to Example 1 that includes a Light Emitting Diode (LED) display comprising a plurality of pixel circuits, each including an LED and a non-volatile memory cell to adjust current to the LED.

Example 2 includes the subject matter of Example 1, wherein the current to the LED is adjusted by applying data voltages to change a threshold voltage of the non-volatile memory cell.

Example 3 includes the subject matter of Examples 1 and 2, wherein the pixel circuits each further comprise a first thin film transistor (TFT) coupled to the gate of the non-volatile memory cell to apply the data voltages and a second TFT coupled to the LED and the non-volatile memory cell.

Example 4 includes the subject matter of Examples 1-3, wherein the first TFT is de-activated and the second TFT is activated during a Reset pulse performed at the non-volatile memory cell.

Example 5 includes the subject matter of Examples 1-4, wherein the first TFT is activated and the second TFT is activated during a Write operation performed at the non-volatile memory cell.

Example 6 includes the subject matter of Examples 1-5, wherein the first TFT is de-activated and the second TFT is de-activated during an Emission operation performed at the non-volatile memory cell.

Example 7 includes the subject matter of Examples 1-6, wherein the non-volatile memory cell comprises a non-volatile memory cell transistor, wherein the non-volatile memory cell transistor is activated to permit current flow to the LED when activated during the Emission operation.

Example 8 includes the subject matter of Examples 1-7, wherein the non-volatile memory cell comprises a top gate, a blocking oxide layer, a charge trapping layer, an Indium gallium zinc oxide (IGZO) layer, a gate oxide layer and a bottom gate.

Example 9 includes the subject matter of Examples 1-8, wherein the charge trapping layer comprises semiconducting nanoparticles.

Example 10 includes the subject matter of Examples 1-9, further comprising source and drain contacts formed without forming junctions.

Some embodiments pertain to Example 11 a non-volatile memory cell comprising a top gate, a blocking oxide layer, a charge trapping layer, an Indium gallium zinc oxide (IGZO) layer a gate oxide layer and a bottom gate.

Example 12 includes the subject matter of Example 11, wherein the charge trapping layer comprises semiconducting nanoparticles.

Example 13 includes the subject matter of Examples 11 and 12, further comprising source and drain contacts formed without forming junctions.

Example 14 includes the subject matter of Examples 11-13, wherein during a WRITE operation the bottom gate is biased to enable an accumulation of electrons to form a channel in the IGZO layer between source and drain contacts, and wherein electrons are trapped by charge trapping layer.

Example 15 includes the subject matter of Examples 11-14, wherein the electrons are trapped by the charge trapping layer, wherein the trapped electrons shifts a threshold voltage of the bottom-gate.

Example 16 includes the subject matter of Examples 11-15, wherein a bias on the top gate accelerates programming of the non-volatile memory cell.

Example 17 includes the subject matter of Examples 11-16, wherein during an ERASE operation the bottom gate is biased to enable a depletion of electrons in the IGZO layer.

Example 18 includes the subject matter of Examples 11-17, wherein a bias on the top gate accelerates the depletion of the electrons.

Example 19 includes the subject matter of Examples 11-18, wherein during a READ operation current from the drain contact is sensed.

Some embodiments pertain to Example 20 a mobile computing device comprising a processor, a memory device and a Light Emitting Diode (LED) display having a plurality of pixel circuits, each including an LED and a non-volatile memory cell to adjust current to the LED.

Example 21 includes the subject matter of Example 20, wherein the current to the LED is adjusted by applying data voltages to change a threshold voltage of the non-volatile memory cell.

Example 22 includes the subject matter of Examples 20 and 21, wherein the pixel circuits each further comprise a first thin film transistor (TFT) coupled to the gate of the non-volatile memory cell to apply the data voltages and a second TFT coupled to the LED and the non-volatile memory cell.

Example 23 includes the subject matter of Examples 20-22, wherein the first TFT is de-activated and the second TFT is activated during a Reset pulse performed at the non-volatile memory cell.

Example 24 includes the subject matter of Examples 20-23, wherein the first TFT is activated and the second TFT is activated during a Write operation performed at the non-volatile memory cell.

Example 25 includes the subject matter of Examples 20-24, wherein the first TFT is de-activated and the second TFT is de-activated during an Emission operation performed at the non-volatile memory cell.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions in any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

What is claimed is:

1. Light Emitting Diode (LED) display comprising a plurality of pixel circuits, each including:

an LED; and a non-volatile memory cell to adjust current to the LED, wherein the current to the LED is adjusted by applying data voltages to change a threshold voltage of the non-volatile memory cell.

2. The LED display of claim 1, wherein the pixel circuits each further comprise:

a first thin film transistor (TFT) coupled to the gate of the non-volatile memory cell to apply the data voltages; and a second TFT coupled to the LED and the non-volatile memory cell.

3. The LED display of claim 2, wherein the first TFT is de-activated and the second TFT is activated during a Reset pulse performed at the non-volatile memory cell.

4. The LED display of claim 3, wherein the first TFT is activated and the second TFT is activated during a Write operation performed at the non-volatile memory cell.

5. The LED display of claim 4, wherein the first TFT is de-activated and the second TFT is de-activated during an Emission operation performed at the non-volatile memory cell.

6. The LED display of claim 5, wherein the non-volatile memory cell comprises a non-volatile memory cell transistor, wherein the non-volatile memory cell transistor is activated to permit current flow to the LED when activated during the Emission operation.

7. The LED display of claim 1, wherein the non-volatile memory cell comprises:

a top gate;

a blocking oxide layer;

a charge trapping layer;

an Indium gallium zinc oxide (IGZO) layer;

a gate oxide layer; and a bottom gate.

8. The LED display of claim 7, wherein the charge trapping layer comprises semiconducting nanoparticles.

9. The LED display of claim 7, further comprising source and drain contacts formed without forming junctions.

10. A non-volatile memory cell comprising:

a top gate;

a blocking oxide layer;

a charge trapping layer adjacent to at least a portion of the block oxide layer;

an Indium gallium zinc oxide (IGZO) layer adjacent to at least a portion of the charge trapping layer;

a gate oxide layer adjacent to at least a portion of the IGZO layer; and a bottom gate.

11. The non-volatile memory cell of claim 10, wherein the charge trapping layer comprises semiconducting nanoparticles.

12. The non-volatile memory cell of claim 10, further comprising source and drain contacts formed without forming junctions.

13. The non-volatile memory cell of claim 10, wherein during a WRITE operation the bottom gate is biased to enable an accumulation of electrons to form a channel in the IGZO layer between source and drain contacts, and wherein electrons are trapped by charge trapping layer.

14. The non-volatile memory cell of claim 10, wherein the electrons are trapped by the charge trapping layer, wherein the trapped electrons shifts a threshold voltage of the bottom-gate.

15. The non-volatile memory cell of claim 10, wherein a bias on the top gate accelerates programming of the non-volatile memory cell.

16. The non-volatile memory cell of claim 10, wherein during an ERASE operation the bottom gate is biased to enable a depletion of electrons in the IGZO layer.

17. The non-volatile memory cell of claim 16, wherein a bias on the top gate accelerates the depletion of the electrons.

18. The non-volatile memory cell of claim 13, wherein during a READ operation current from the drain contact is sensed.

19. A mobile computing device comprising:

a processor;

a memory device; and a Light Emitting Diode (LED) display having a plurality of pixel circuits, each including:

an LED; and a non-volatile memory cell to adjust current to the LED, wherein the current to the LED is adjusted by applying data voltages to change a threshold voltage of the non-volatile memory cell.

20. The mobile computing device of claim 19, wherein the pixel circuits each further comprise:

a first thin film transistor (TFT) coupled to the gate of the non-volatile memory cell to apply the data voltages; and a second TFT coupled to the LED and the non-volatile memory cell.

21. The mobile computing device of claim 20, wherein the first TFT is de-activated and the second TFT is activated during a Reset pulse performed at the non-volatile memory cell.

22. The mobile computing device of claim 21, wherein the first TFT is activated and the second TFT is activated during a Write operation performed at the non-volatile memory cell.

23. The mobile computing device of claim 22, wherein the first TFT is de-activated and the second TFT is de-activated during an Emission operation performed at the non-volatile memory cell.

* * * * *